US007333070B2

(12) United States Patent
Kuroda et al.

(10) Patent No.: US 7,333,070 B2
(45) Date of Patent: Feb. 19, 2008

(54) RADIO WAVE LENS ANTENNA DEVICE

(75) Inventors: Masatoshi Kuroda, Osaka (JP); Katsuyuki Imai, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 55 days.

(21) Appl. No.: 10/584,272

(22) PCT Filed: Dec. 22, 2004

(86) PCT No.: PCT/JP2004/019216

§ 371 (c)(1),
(2), (4) Date: Jun. 23, 2006

(87) PCT Pub. No.: WO2005/062425

PCT Pub. Date: Jul. 7, 2005

(65) Prior Publication Data

US 2007/0126653 A1 Jun. 7, 2007

(30) Foreign Application Priority Data

Dec. 24, 2003 (JP) ..... 2003-427506

(51) Int. Cl.
*H01Q 15/08* (2006.01)

(52) U.S. Cl. ..... 343/911 L; 343/911 R; 343/754

(58) Field of Classification Search ..... 343/909, 343/911 R, 911 L, 753, 754
See application file for complete search history.

(56) References Cited

U.S. PATENT DOCUMENTS 4,531,129 A * 7/1985 Bonebright et al. ..... 343/754
6,266,029 B1 * 7/2001 Lee et al. ..... 343/911 L
6,329,956 B1 * 12/2001 Tateishi et al. ..... 343/753
6,356,247 B1 * 3/2002 Hirtzlin et al. ..... 343/911 L
2004/0263418 A1 * 12/2004 Kuroda et al. ..... 343/909
2006/0145940 A1 * 7/2006 Kuroda et al. ..... 343/911 R

FOREIGN PATENT DOCUMENTS

JP 2001-44746 A 2/2001
JP 2003-110349 A 4/2003
JP 2003-110352 A 4/2003
JP 2004-297789 A 10/2004

OTHER PUBLICATIONS

Richard C. Johnson, Antenna Engineering Handbook, 3rd Edition, Jan. 1993, pp. 17/17-17/21.

* cited by examiner

*Primary Examiner*—Hoang V. Nguyen
(74) *Attorney, Agent, or Firm*—McDermott Will & Emery LLP

(57) ABSTRACT

An antenna device using an approximate Luneberg lens, wherein high gain and low side-lobe are made compatible. A lens antenna device comprising, combine with each other, a radio wave lens (1) formed of a dielectric satisfying the condition, $0<a\leqq r$, where the distance from the front surface of a lens (4) to the focal point of the lens is a, and the radius of the lens r, and a primary radiator (2) having a 10-dB beam width θ wherein A, determined by the expression, $A=\theta/2\times(1+2a/r)$, is at least 40 and up to 80, more preferably at least 50 and up to 70.

3 Claims, 13 Drawing Sheets

RADIO WAVE LENS ANTENNA DEVICE

RELATED APPLICATIONS

This application is the U.S. National Phase under 35 U.S.C. § 371 of International Application No. PCT/JP2004/019216, filed on Dec. 22, 2004, which in turn claims the benefit of Japanese Application No. 2003-427506, filed on Dec. 24, 2003, the disclosures of which Applications are incorporated by reference herein.

FIELD OF THE INVENTION

The present invention relates to a lens antenna achieving a high gain and a low side-lobe, which is constructed by combining a radio wave lens based on a Luneberg lens with a primary feed.

Further, the radio wave lens based on the Luneberg lens indicates a lens designed to have refractive characteristics of a radio wave approximate to those of the Luneberg lens and satisfy the condition, $0<a\leqq r$, where a denotes a distance from a surface of the lens to a focal point of the lens and r denotes a radius of the lens (hereinafter, referred to as an 'approximate Luneberg lens')

BACKGROUND OF THE INVENTION

An antenna using the Luneberg lens has been known to be effective as a multi-beam antenna and is expected as an antenna for receiving or transmitting radio waves from or to satellites However, in order to attain maximum performance of the antenna such as the high gain and the low side-lobe, optimization of a feed is required and becomes important.

A parabolic antenna includes a parabolic reflector and a LNB (low noise block down converter); and the radio waves are reflected at the parabolic reflector to be focused into a focal point while a lens antenna includes a lens and a LNB; and the radio waves are refracted through the interior of the lens to be focused into a focal point thereof.

Therefore, antennas each using the parabolic antenna and the approximate Luneberg lens differ from each other in the principles and conditions; and therefore the optimum feeds of those are not always identical to each other.

As for the parabolic antenna, a primary feed is described in, e.g., Reference 1.

Reference 1: "Antenna Engineering Handbook", 3rd Edition, 17-17~17-21

Reference 1 discloses that if θ1 indicates an angle subtended between edges of the parabolic reflector (dish) from the primary feed, the primary feed with an antenna pattern where a gain at a position of an angle θ1 is 10 dB down from a main gain is beneficial in the gain and the side-lobe.

Regarding the approximate Luneberg lens, there have been already designed ones which sufficiently meet the practical use. Nevertheless, no matter how good performance of the lens is, performance of the antenna is not improved without a proper feed.

In the parabolic antenna, an antenna gain changes depending on the change of a beam width. If the beam width is too broad, the leakage of the radio waves occurs, so that the gain is reduced. If, on the other hand, the beam width is too narrow, some areas of the parabolic reflector are unable to be used, causing the decreased gain.

Further, as the beam width of the primary feed of the parabolic antenna is narrower, the side-lobe of the antenna is reduced. It is generally known that the side-lobe is reduced by producing a tapered power distribution by decreasing power at an edge of an aperture surface of the parabolic antenna. On the other hand, it accompanies gradual loss of the gain and the gain decreases rapidly if the beam width of the primary feed is narrowed to a certain extent thereof.

In case of the lens antenna, the side-lobe can also be reduced by narrowing a beam width of the primary feed combined with the lens in the same manner as shown in the above. However, since an aperture surface of the lens can not be utilized efficiently for an antenna gain, the antenna gain is rapidly reduced at a certain position of the beam width of the primary feed. As a result, it is not easy to make the high gain and the low side-lobe compatible.

In particular, in case of the antenna using the approximate Luneberg lens, characteristics of the lens are far from the ideal unlike in the parabolic antenna where a physically ideal curved surface can be formed and a position of the focal point is determined by a curvature of the curved surface. For example, discontinuity in relative dielectric constant caused by a structure thereof or variation of the refractive index of the radio wave occurred in manufacturing of a practical lens is inevitable and such variation results in the increased side-lobe. Therefore, it is much even more difficult to make the high gain and the low side-lobe compatible compared to the parabolic antenna.

Optimization of the feed is required to achieve the maximum performance of the antenna using the approximate Luneberg lens. However, since the antenna using the approximate Luneberg lens is an antenna which has recently turned out to have practical use, parameters for obtaining an optimal feed were not found out.

As described above, since the antenna using the approximate Luneberg lens differs from the parabolic antenna in the principles and conditions and has problems such as discontinuity in relative dielectric constant caused by the structure and variation of the refractive index of the radio wave occurred in manufacturing of the practical lens, the performance of the primary feed can not be determined by applying a conception of the parabolic antenna thereto in the same way. In view of this, the optimization of the feed is insufficient and, therefore, the sufficient performance of the antenna is not achieved. Accordingly, a solution to the above problems is required.

SUMMARY OF THE INVENTION

In order to solve the above problems, in accordance with the present invention, there is provided a radio wave lens (approximate Luneberg lens), the radio wave lens being formed of a dielectric material which satisfies the condition, $0<a\leqq r$, where a denotes a distance from a surface of the lens to a focal point of the lens and r denotes a radius of the lens, combined with a primary feed which has a 10 dB beam width θ, θ denoting the 10 dB beam width of the primary feed, where A determined by the formula of $A=\theta/2\times(1+2a/r)$ is at least 40 and up to 80.

Herein, the 10 dB beam width indicates a beam width at 10 dB down from the maximum gain of a radio wave as shown in FIG. 15.

The primary feed is preferably set to have θ where A is at least 50 to 70.

In accordance with the present invention, the radio wave lens is constructed by combining a hemispherical lens with a reflective plate where a part of a reflective surface is protruded outward from the lens toward an incoming direction of a radio wave; and a lens antenna which includes the radio wave lens, the primary feed and a supporting unit for supporting the primary feed at a fixed position is considered as an embodiment. Further, it is suitable for performing reception and transmission from or to geostationary satellites.

In case that the 10 dB beam width θ of the primary feed combined with the approximate Luneberg lens is determined as described above, a radio wave lens antenna with a lower side-lobe and a non-significantly reduced gain can be obtained.

By finding out those parameters, it becomes possible to provide a high performance antenna with a high gain and a low side-lobe with saved development time and period.

DESCRIPTION OF THE REFERENCE NUMERAL

Figure 1:
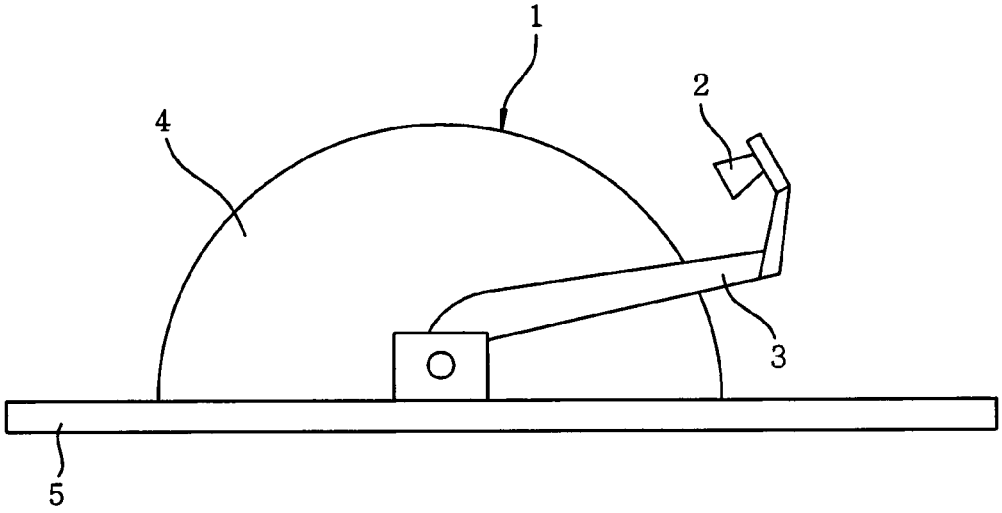
FIG. 1 offers a side view of an exemplary lens antenna in accordance with the present invention.

1 radio wave lens
2 primary feed
3 supporting unit
4 lens
5 reflective plate
6 radome
7 spectrum analyzer
S focal point
O center of lens
a distance from surface of lens to focal point
r radius of lens

DETAILED DESCRIPTION OF THE PREFERRED EMBODIMENT

Hereinafter, a preferred embodiment of the present invention will be described with reference to the accompanying drawings. A lens antenna shown in FIG. 1 includes a radio wave lens 1, a primary feed 2 disposed at a focal point of the radio wave lens 1 (focal point of a position corresponding to a geostationary satellite of a communication target) and a supporting unit 3 capable of supporting the primary feed 2 at a fixed position.

The illustrated radio wave lens 1 is constructed by combining a hemispherical lens 4 formed of a dielectric material with a reflective plate 5 attached to a half-cut surface of a sphere of the lens 4.

Figure 2:
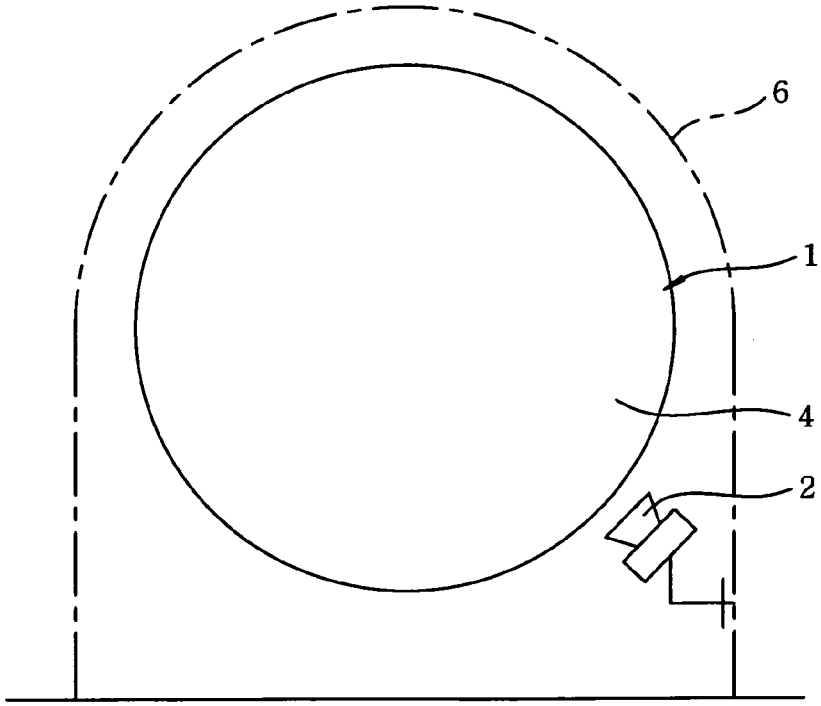
FIG. 2 shows a side view of another exemplary lens antenna in accordance with the present invention.

The radio wave lens 1 may be constructed by combining a primary feed with a spherical lens 4 shown in FIG. 2 or a quarter-spherical lens. The spherical lens 4 of FIG. 2 is supported by a radome 6.

Figure 3:
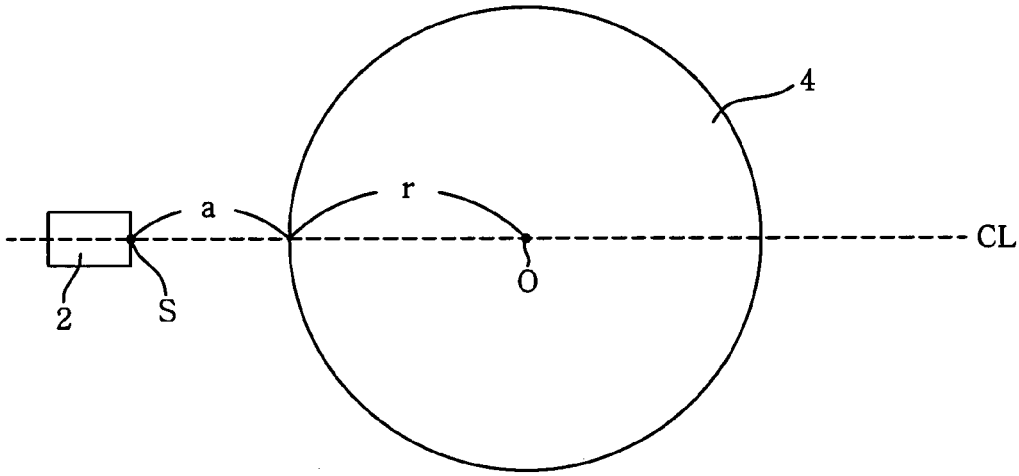
FIG. 3 presents a relation between a distance from a surface of a lens to a focal point of the lens and a radius of the lens.

The lens 4 which is an approximate Luneberg lens formed by laminating layers having different relative dielectric constants refracts a radio wave incoming from a certain direction to be focused at a focal point. The lens 4 is formed of the dielectric material which satisfies the condition, $0<a\leqq r$, where a denotes a distance from a surface of the lens to the focal point of the lens and r denotes a radius of the lens as shown in FIG. 3.

Further, the primary feed 2 has a 10 dB beam width of θ, θ denoting the 10 dB beam width of the primary feed, where A determined by the formula of $A=\theta/2\times(1+2a/r)$ is at least 40 and up to 80 and, more preferably, at least 50 and up to 70.

Furthermore, the primary feed 2 reaches the lens in case of a=0 and, therefore, the primary feed 2 can not be installed. In case of a>r, since the primary feed 2 is too distant from the lens, it results in a large volume of an antenna which becomes worthless as a sellable product. To avoid these problems, the condition of $0<a\leqq r$ is satisfied.

One of a conical horn antenna, a pyramidal horn antenna, a corrugated horn antenna, a dielectric rod antenna, a dielectric material loaded horn antenna, a micro strip antenna (MSA) or the like can be used as the primary feed 2, but is not limited thereto.

A dimension of the reflective plate 5 is larger than that of the lens 4 in a manner that a part of a reflective surface is protruded outward from the lens toward an incoming direction of the radio wave.

As the supporting unit 3, an arch-type arm which is capable of adjusting an elevation angle is employed in the antenna of FIG. 1, but a fixed stand or the like can be used.

Preferred Embodiments

Hereinbelow, preferred embodiments of the present invention will be described in detail. The followings are prepared as the approximate Luneberg lens:

lens: a diameter ϕ of 370 mm; a hemispherical shape; and 8 layers in total, a/r=0.005, 0.04, 0.09, 0.14, 0.25, 0.35, 0.51, 0.71 and 0.93; and 9 cases in total.

Further, corrugated horn antennas CH-1 to CH-9, each having a different 10 dB beam width are prepared as the primary feed.

TABLE 1

| | 10 dB beam width (degrees) |
|---|---|
| CH-1 | 54.0 |
| CH-2 | 65.2 |
| CH-3 | 76.4 |
| CH-4 | 87.6 |
| CH-5 | 99.2 |
| CH-6 | 110.0 |
| CH-7 | 120.8 |
| CH-8 | 130.8 |
| CH-9 | 140.4 |

Next, the lens antenna is constructed by combining, respectively, each lens having the reflective plate attached thereto with the corrugated horn antennas CH-1 to CH-9 in Table 1 and, thereafter, a gain of each lens antenna and an excess rate from the following basis of a side-lobe at 12.7 GHz are obtained.

Figure 4:
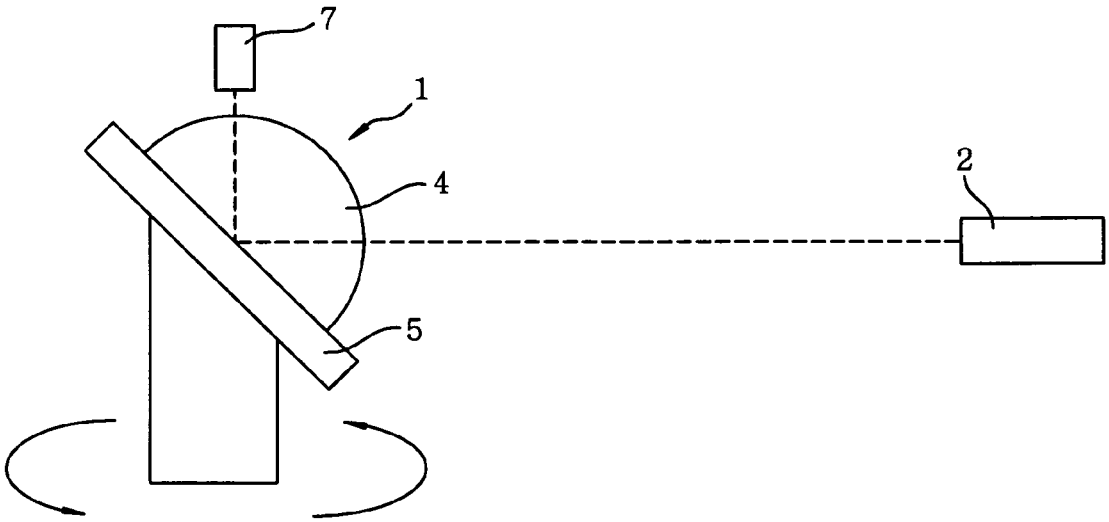
FIG. 4 sets forth a performance measuring method of the lens antenna.
Figure 5:
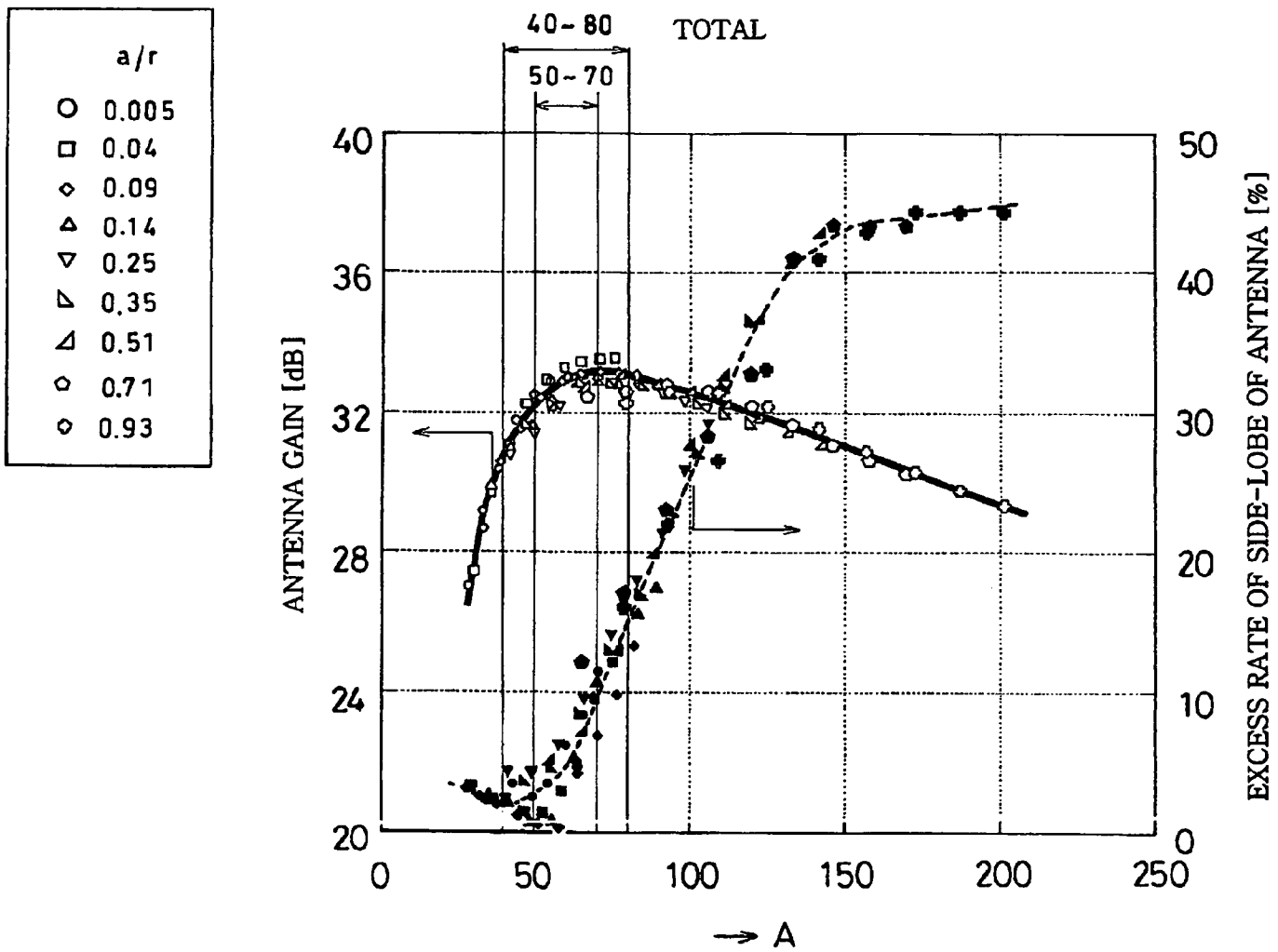
FIG. 5 illustrates performance measure results of the lens antenna.
Figure 6:
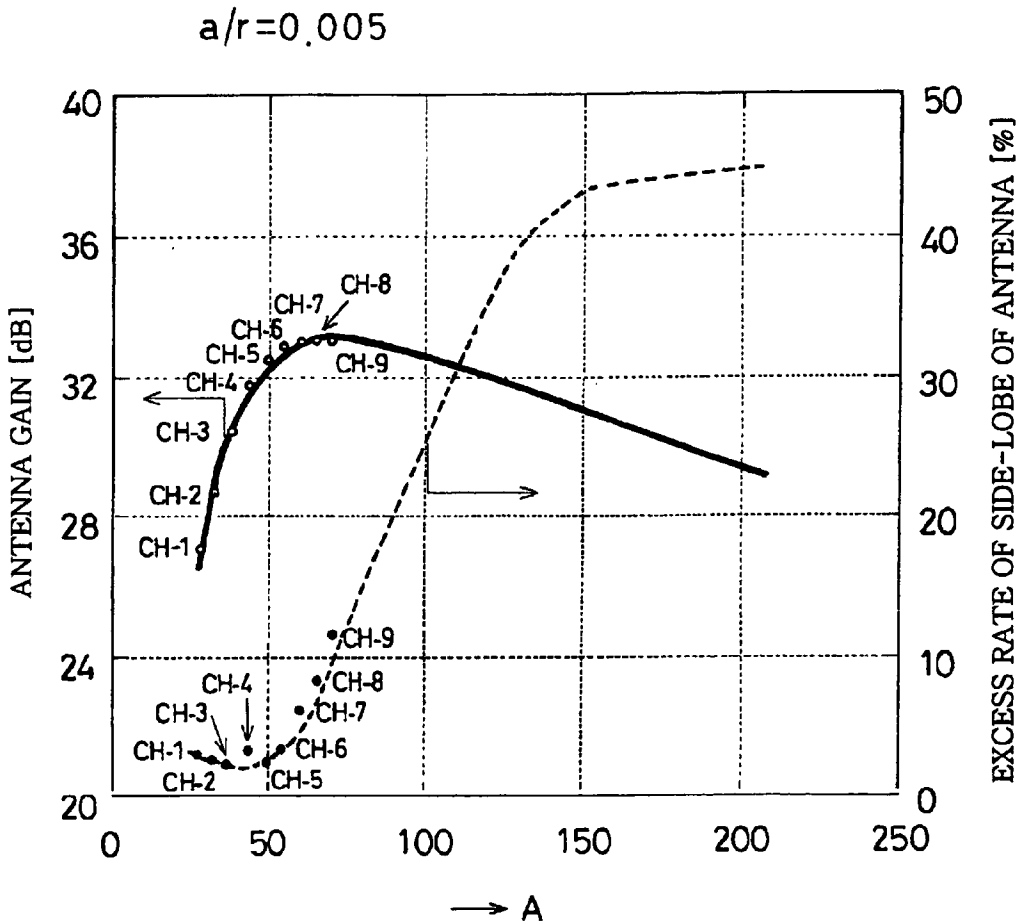
FIG. 6 shows data in case of a/r=0.005.
Figure 7:
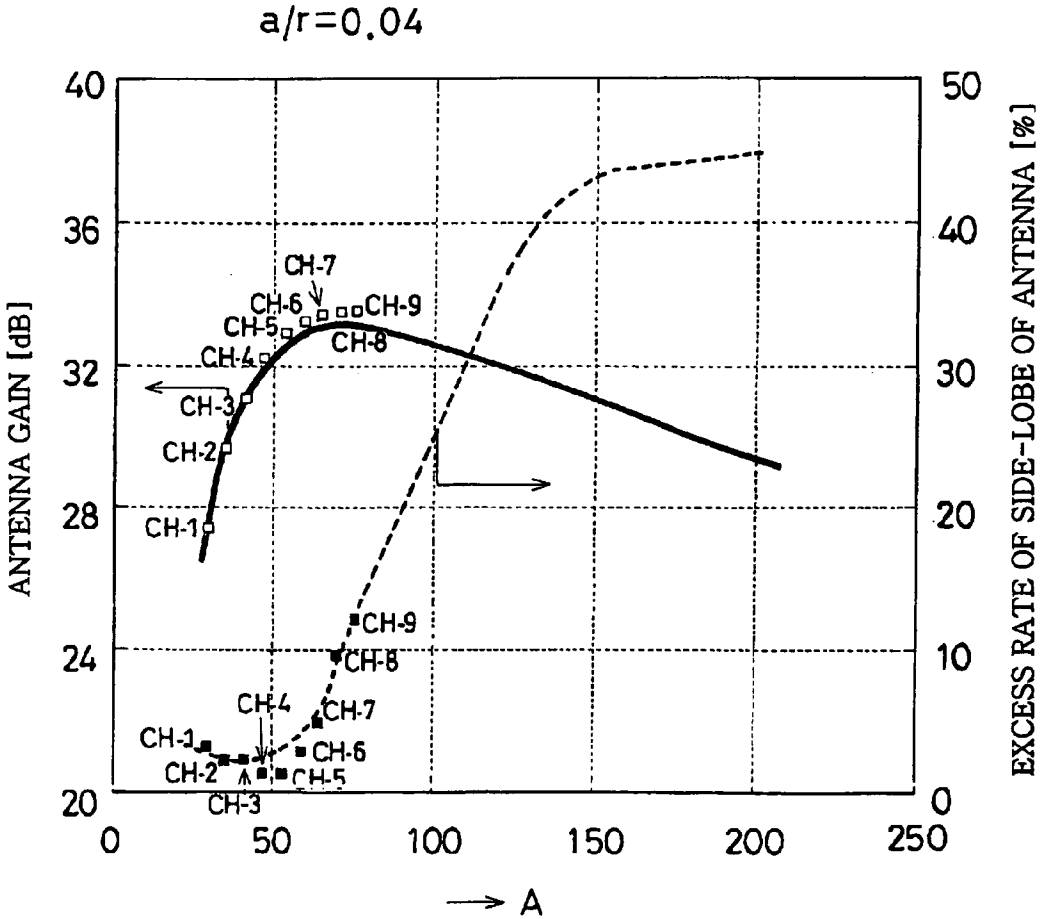
FIG. 7 shows data in case of a/r=0.04.
Figure 8:
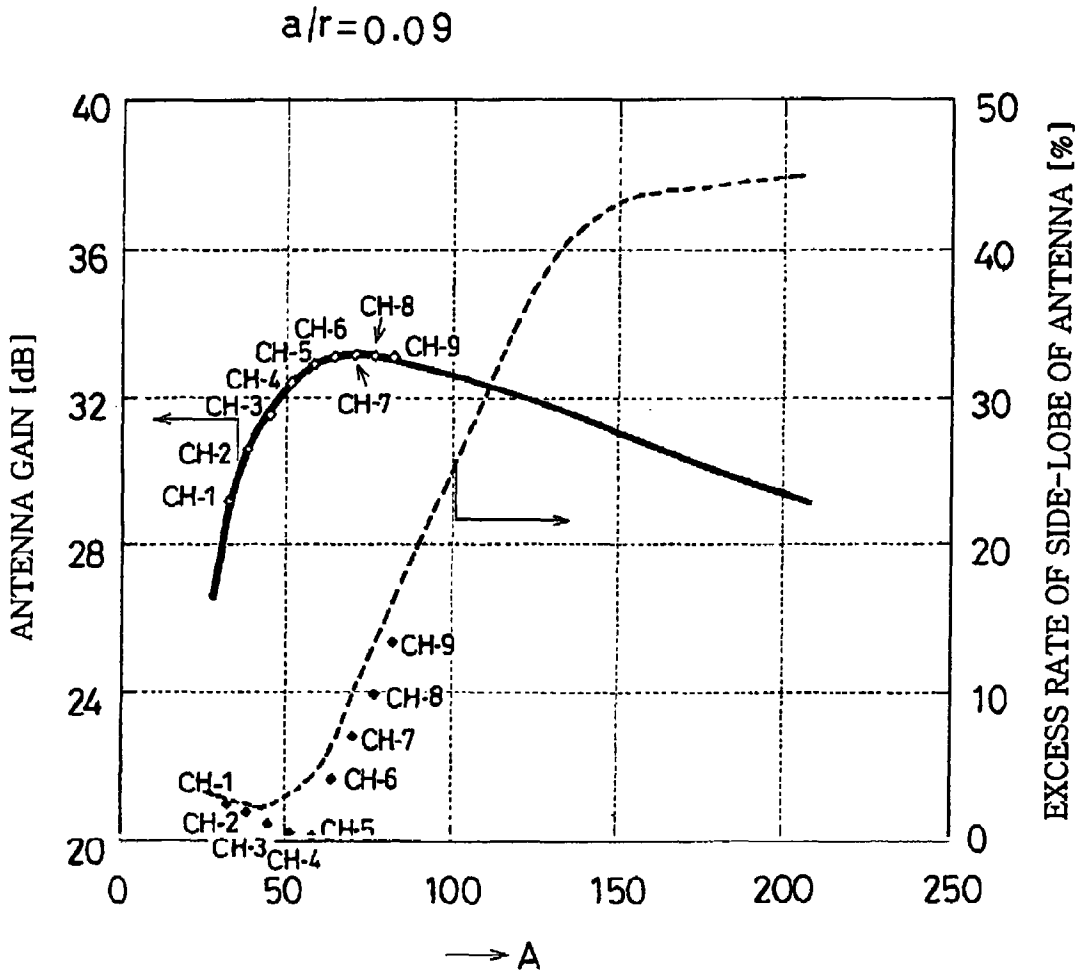
FIG. 8 shows data in case of a/r=0.09.
Figure 9:
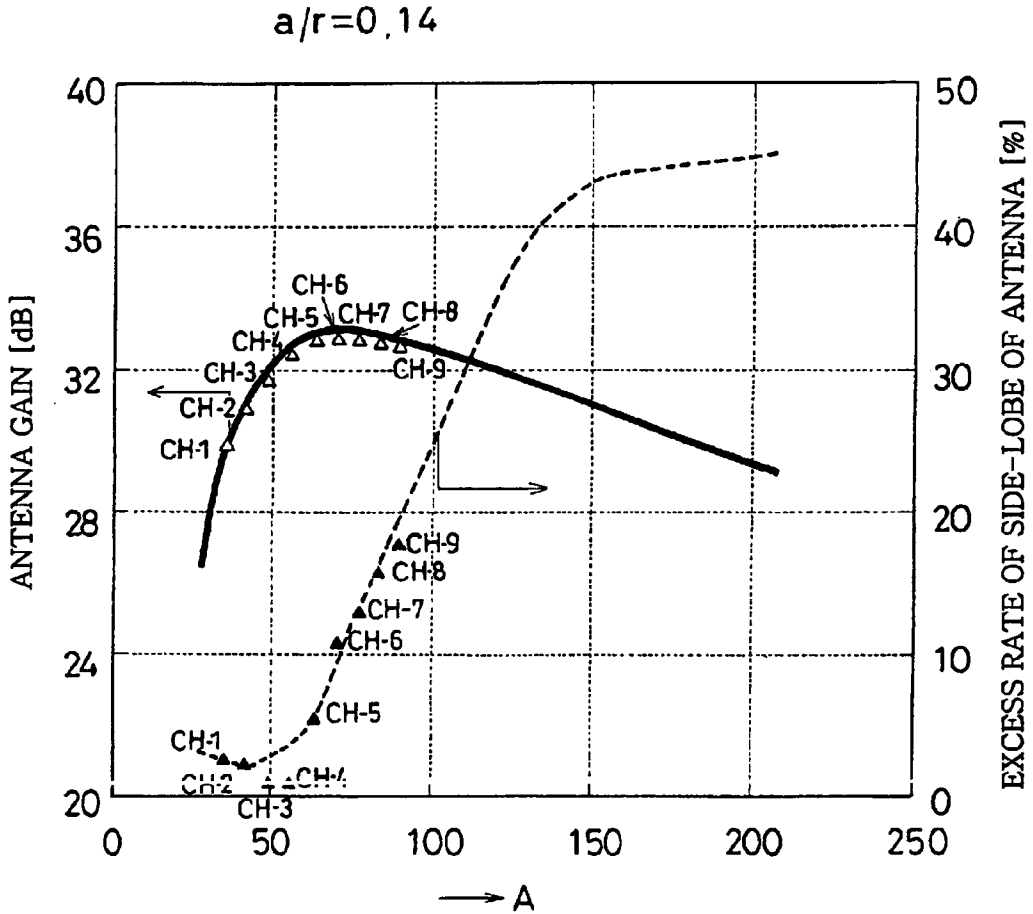
FIGS. 9 shows data in case of a/r=0.14.
Figure 10:
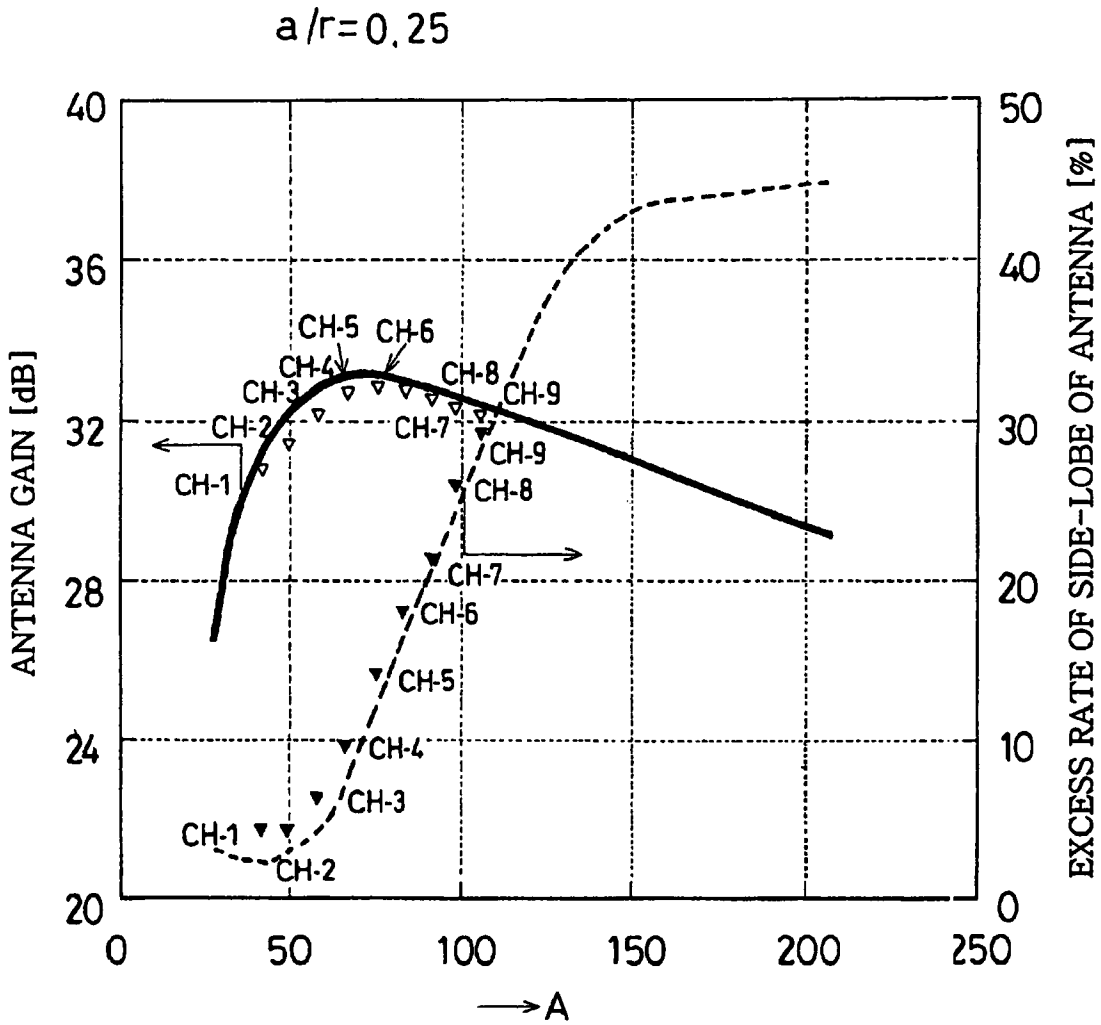
FIGS. 10 shows data in case of a/r=0.25.
Figure 11:
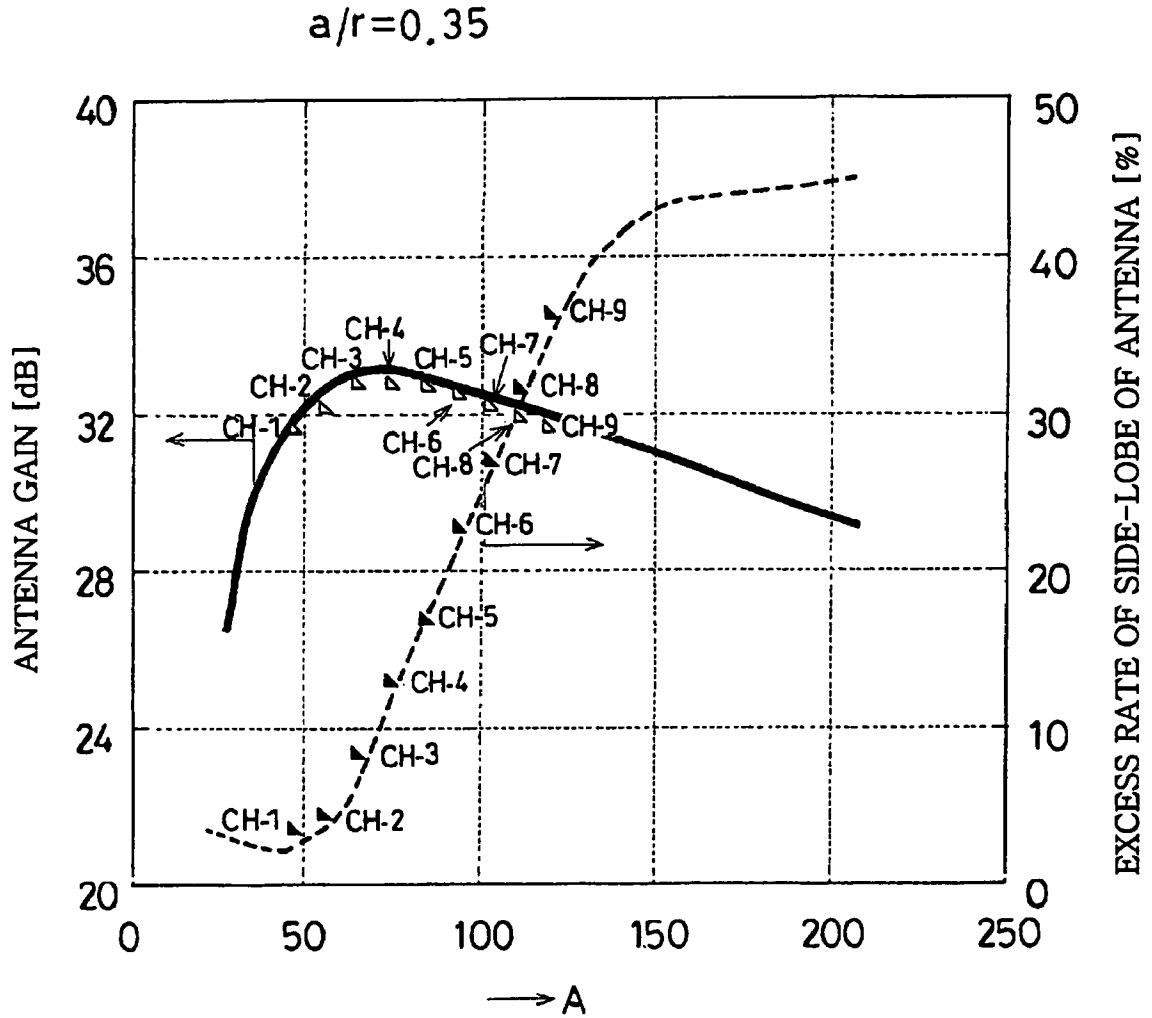
FIG. 11 shows data in case of a/r=0.35.
Figure 12:
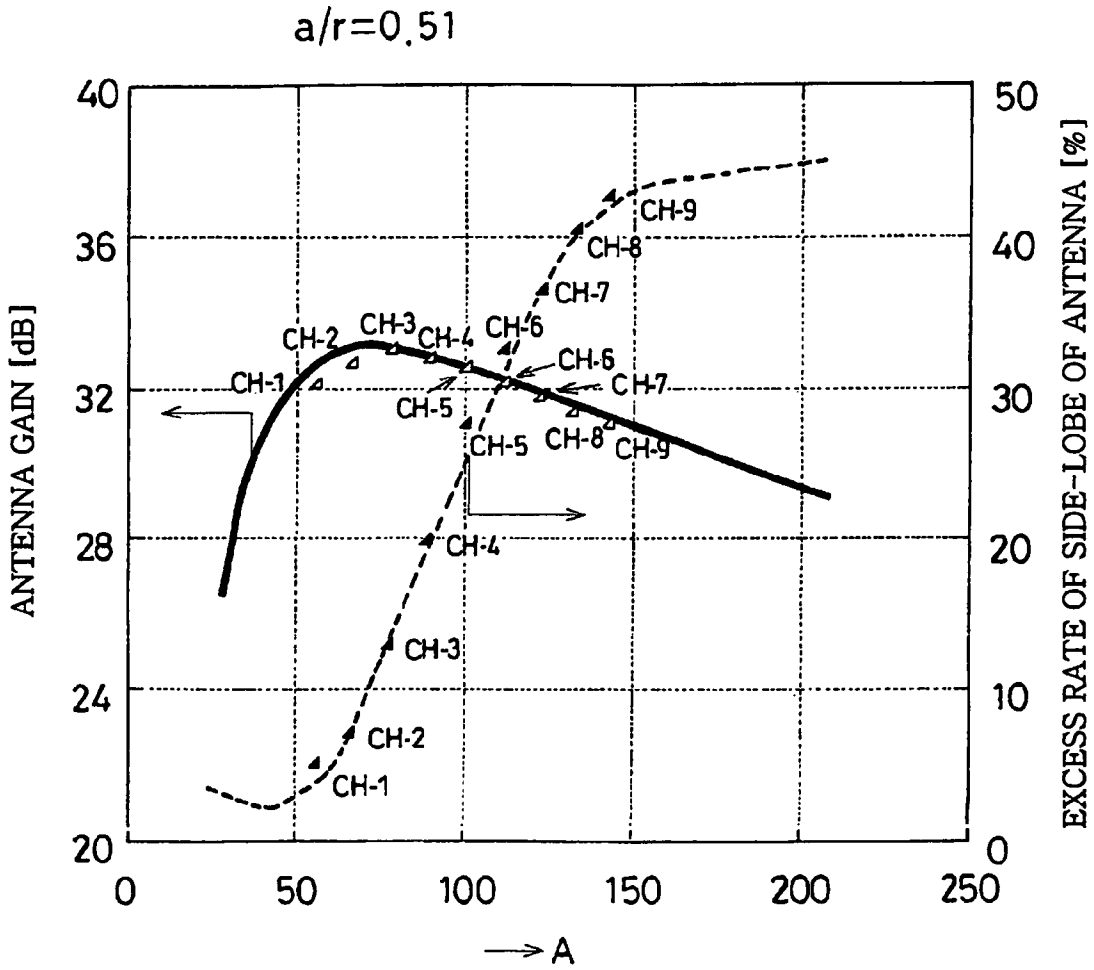
FIG. 12 shows data in case of a/r=0.51.
Figure 13:
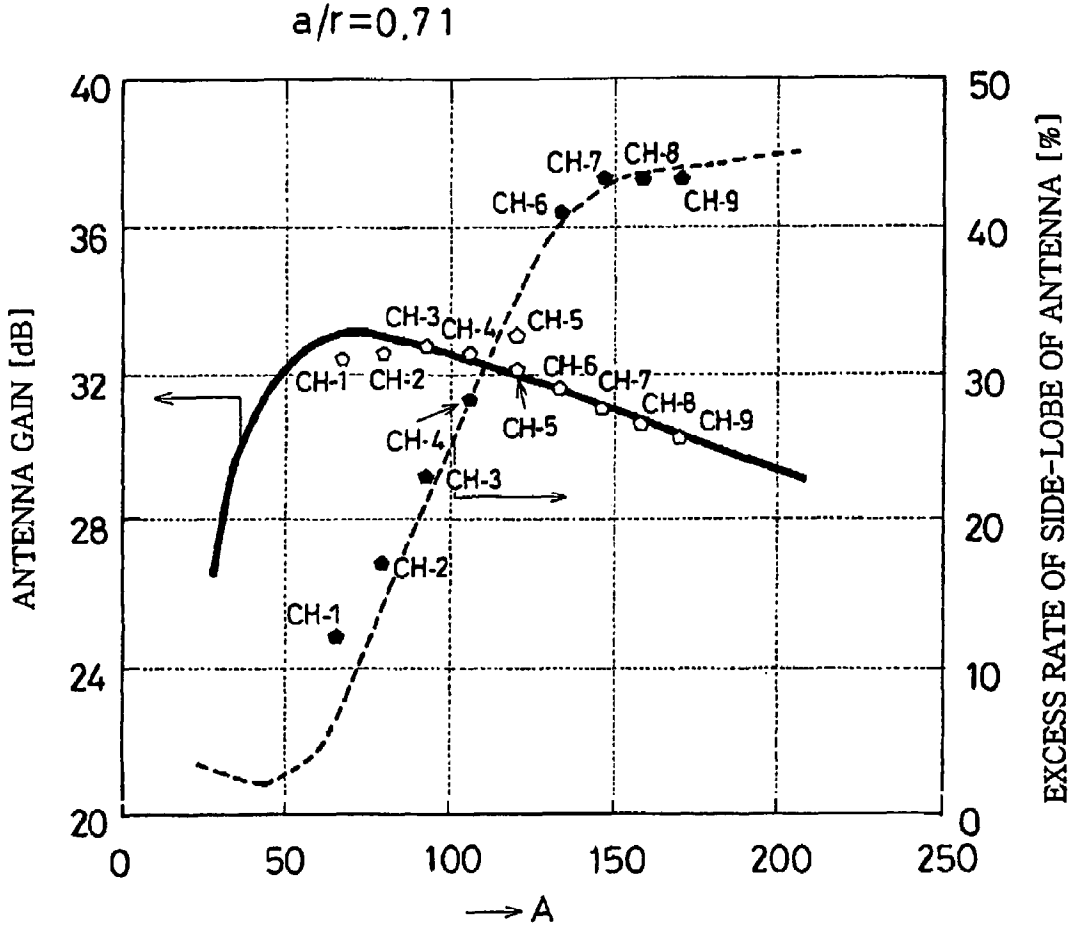
FIG. 13 shows data in case of a/r=0.71.
Figure 14:
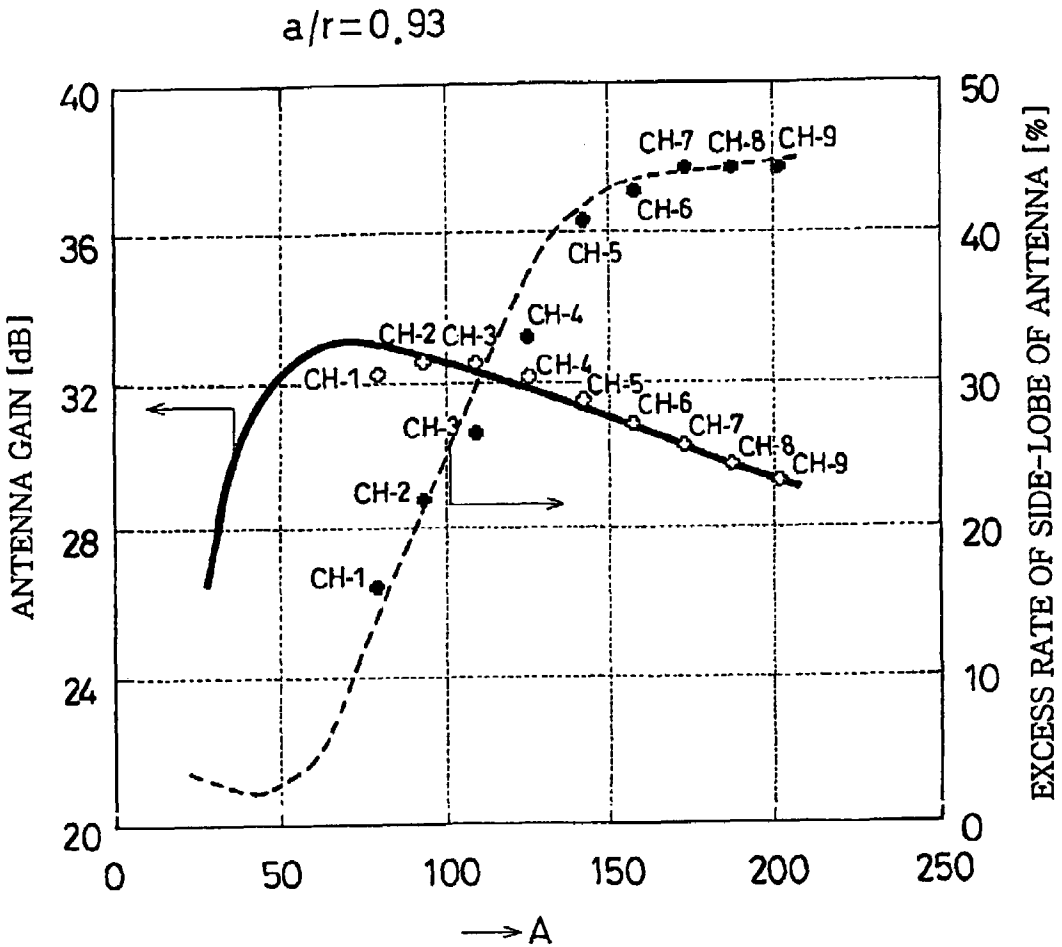
FIG. 14 shows data in case of a/r=0.93.
Figure 15:
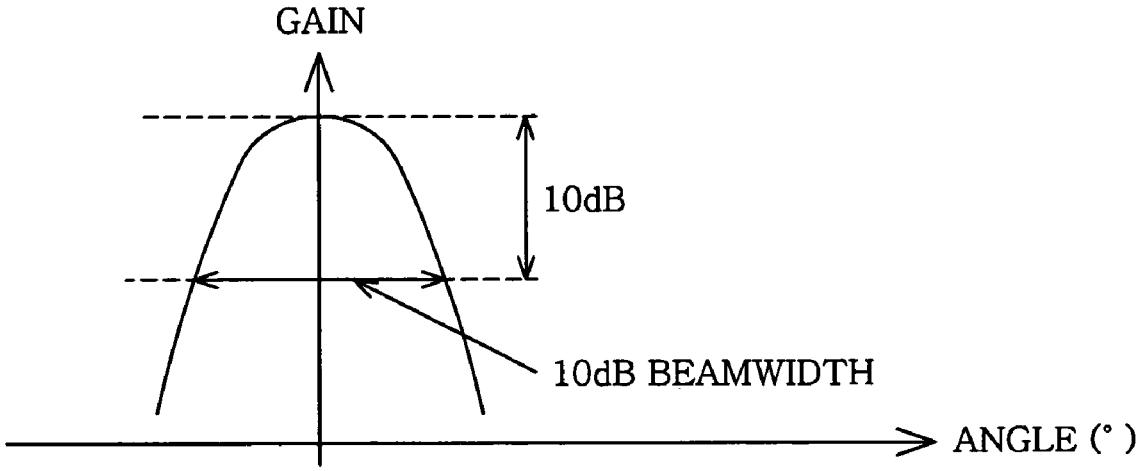
FIG. 15 illustrates the definition of a 10 dB beam width of a primary feed.

The gain and the excess rate of the side-lobe are measured by a measuring device of FIG. 4 using a spectrum analyzer 7. The results are illustrated in FIG. 5. Referring to FIG. 5, a solid line represents a relation between A determined by the formula of $A=\theta/2\times(1+2a/r)$ and the gain of the lens antenna while a dotted line indicates a relation between A and the excess rate of the side-lobe.

Basis of side-lobe:

| | |
|---|---|
| 1) $29-25\log\theta$ | $(4.4° \leqq \theta < 30°)$ |
| 2) $-8$ | $(30° \leqq \theta < 90°)$ |
| 3) 0 | $(90° \leqq \theta < 180°)$ |

FIGS. 6 to 14 respectively illustrate data in case of a/r=0.005, 0.04, 0.09, 0.14, 0.25, 0.35, 0.51, 0.71 and 0.93. FIG. 5 shows overlap of data given in FIGS. 6 to 14. Each gain and each excess rate of the side-lobe of each antenna are largely concentrated at a position gathered along a curved line. Accordingly, by using A of the previous formula as a parameter, it is noted that the optimum feed of the antenna can be derived.

If performance of aperture efficiency of 50% or above (a gain of 31 dB) and a side-lobe of 20% and below is satisfied, it can be utilized as an antenna, thereby leading to the condition of $40 \leqq A \leqq 80$. Further, if performance of aperture efficiency of 65% or above (a gain of 32 dB) and a side-lobe of 10% and below is satisfied, it can be a more preferable antenna, thereby resulting in a more preferable value A, $50 \leqq A \leqq 70$.

What is claimed is:

1. A lens antenna comprising:

a radio wave lens, the radio wave lens having refractive characteristics of a radio wave approximate to those of a Luneberg lens and formed of a dielectric material which satisfies the condition, $0<a \leqq r$, where a denotes a distance from a surface of the lens to a focal point of the lens and r denotes a radius of the lens; and a primary feed having a 10 dB beam width θ, where θ denotes the 10 dB beam width of the primary feed and A determined by the formula of $A=\theta/2\times(1+2a/r)$ is at least 40 and up to 80.

2. The lens antenna of claim 1, the 10 dB beam width θ of the primary feed is set to have A of at least 50 to 70.

3. The lens antenna of claim 1 or 2, wherein the radio wave lens includes a hemispherical lens and a reflective plate where a part of a reflective surface is protruded outward from the lens toward an incoming direction of the radio wave, and the lens antenna further comprising a supporting unit for supporting the primary feed at a fixed position to perform reception and transmission from or to geostationary satellites.

* * * * *